US011827312B2

(12) United States Patent
Todter

(10) Patent No.: US 11,827,312 B2
(45) Date of Patent: Nov. 28, 2023

(54) METHOD AND APPARATUS FOR REDUCING A HEELING MOMENT OF A SAILING VESSEL

(71) Applicant: SubSeaSail LLC, San Diego, CA (US)

(72) Inventor: Chris Todter, San Diego, CA (US)

(73) Assignee: SubSeaSail LLC, San Diego, CA (US)

( * ) Notice: Subject to any disclaimer, the term of this patent is extended or adjusted under 35 U.S.C. 154(b) by 0 days.

(21) Appl. No.: 17/526,210

(22) Filed: Nov. 15, 2021

(65) Prior Publication Data

US 2022/0153389 A1 May 19, 2022

Related U.S. Application Data

(60) Provisional application No. 63/113,838, filed on Nov. 14, 2020.

(51) Int. Cl.
*B63B 15/02* (2006.01)
*B63B 15/00* (2006.01)

(52) U.S. Cl.
CPC ..... *B63B 15/02* (2013.01); *B63B 15/0083* (2013.01); *B63B 2015/0058* (2013.01)

(58) Field of Classification Search
CPC ..... B63B 2015/001; B63B 2015/005; B63B 2015/0058; B63B 2015/0066; B63B 15/0083; B63B 15/02; B63B 39/00; B63B 39/02; B63B 2039/065; B63B 2039/067; B63B 39/062
USPC ..... 114/90, 91
See application file for complete search history.

(56) References Cited

U.S. PATENT DOCUMENTS 2,353,007 A * 7/1944 Blackman ..... B63B 15/02 114/91
3,323,480 A * 6/1967 Criou ..... B63B 15/02 114/91
3,610,190 A * 10/1971 Palmer ..... B63B 15/02 114/91
3,696,772 A 10/1972 Sundelin
3,954,077 A 5/1976 Piat-Marchand
4,192,247 A 3/1980 Riordan
4,501,215 A * 2/1985 Hart ..... B63B 15/02 114/91
4,785,754 A * 11/1988 Barberis ..... B63B 15/02 114/39.26
5,176,091 A 5/1993 Burnham
5,570,651 A 11/1996 Schiff
5,724,905 A * 3/1998 Pizzey ..... B63H 9/06 114/274
5,848,574 A 12/1998 Lande
(Continued)

FOREIGN PATENT DOCUMENTS

FR 2770482 5/1999

OTHER PUBLICATIONS

Orma Ocean Racing Multihull Association, 2004—Class Rules Safety regulations, general publication, Dec. 1, 2003, Orma, Paris, France.

*Primary Examiner* — Daniel V Venne
(74) *Attorney, Agent, or Firm* — Thibault Patent Group

(57) ABSTRACT

Various embodiments of a sailing vessel are disclosed configured to reduce a heeling moment acting on the sailing vessel as a wind acts on a sail of the sailing vessel. Generally, a mast of the sailing vessel is allowed to cant to leeward, thus reducing the heeling moment.

15 Claims, 9 Drawing Sheets

(56) References Cited

U.S. PATENT DOCUMENTS

| | | | | |
|---|---|---|---|---|
| 5,908,005 | A * | 6/1999 | Everett | B63B 43/02 114/91 |
| 5,947,045 | A * | 9/1999 | Pietro | B63B 15/0083 114/39.28 |
| 7,568,442 | B2 | 8/2009 | Kruppa | |
| 8,065,969 | B2 * | 11/2011 | Bachmann | B63B 15/02 114/39.21 |
| 10,633,058 | B1 | 4/2020 | Rawdon | |
| 10,710,685 | B2 | 7/2020 | Cronwright | |
| 10,996,676 | B2 | 5/2021 | Johnson et al. | |
| 11,117,642 | B2 | 9/2021 | Hofbauer | |

* cited by examiner

METHOD AND APPARATUS FOR REDUCING A HEELING MOMENT OF A SAILING VESSEL

CROSS REFERENCE TO RELATED APPLICATION

The present application claims the benefit of provisional application No. 63/113,838 entitled "Method and Apparatus to Reduce Heeling Moments for Sailing Vessels" filed on Nov. 14, 2020.

BACKGROUND

Field of Use

The present application relates to the maritime industry. More specifically, the present application relates to sailing vessels.

Description of the Related Art

Sailing vessels universally have a heeling, or roll, moment applied to their hulls by virtue of an aerodynamic force generated by the vessels' sails, mast or wing (collectively, the "rig") during the normal generation of thrust used to propel the vessel. This heeling moment must be resisted by the vessel or the vessel will simply roll over to the horizontal.

Monohull vessels generate a righting, or restoring, moment to resist the heeling moment by virtue of their hull shape and the arrangement of ballast such that the center of gravity (CG) of a monohull vessel is lower in the water than its center of buoyancy (CB), and the heeling moment produces some amount of roll in the vessel that separates the CG and CB laterally, thus forming a restoring moment.

Multihull sailing vessels generate righting moments by virtue of their arrangement of hulls and aerodynamic arrangement of their mast, sails, and/or wings. A multihull vessel generates a righting moment because the roll moment raises the CG above the CG when the vessel is at a rest position, which generates a restoring moment in conjunction with the CB.

The action of a monohull to resist a rolling moment is inherently safe and self-restoring because more roll moment (caused by stronger wind) generally generates a greater righting moment, but rolling the vessel and particularly the mast, sails, and/or wing actually reduces the rolling moment, as aerodynamic forces on the sails are reduced by a function of the roll angle, i.e., by approximately a cosine of the roll angle. Thus, a vessel generally reaches an equilibrium roll when the rolling moment equals the righting moment. If the wind increases, the vessel may roll further, but the equilibrium angle is always less than fully horizontal, thus ensuring the vessel will right itself with lessening wind speed, providing that the vessel doesn't take on water when rolled significantly.

On the other hand, a multihull vessel (i.e., a catamaran (2 hulls) or a trimaran (3 hulls)), will eventually reach a roll angle where it will continue rolling to full horizontal (i.e., capsize), even without wind forces. The angle at which the multihull vessel will capsize may be referred to as a "capsize angle" and means that the vessel will not right itself after the capsize angle is exceeded—obviously a catastrophic situation for either a manned or unmanned vessel.

It would be desirable, therefore, to design a new type of sailing vessel that reduces the heeling moment, especially for multihull vessels, so that sailing vessels may continue sailing in conditions that would normally roll a single hull vessel to extreme angles, or that would capsize a multihull vessel.

SUMMARY

The embodiments described herein relate to a sailing vessel configured to reduce a heeling moment acting on the sailing vessel as a wind acts on a sail of the sailing vessel. In one embodiment, a sailing vessel is described, comprising, a hull, a mast, a sail coupled to the mast, and means for allowing the mast to cant to port or to starboard in a leeward direction when a wind acts on the sail.

In another embodiment, a method for reducing a heeling moment acting on a sailing vessel is described, comprising automatically allowing a mast of the sailing vessel to cant in a leeward direction when a wind acts on a sail coupled to the mast, thus maintaining the sailing vessel at an angle with respect to an imaginary vertical axis of less than a maximum heeling angle.

BRIEF DESCRIPTION OF THE DRAWINGS

The features, advantages, and objects of the embodiments of the present invention will become more apparent from the detailed description as set forth below, when taken in conjunction with the drawings in which like referenced characters identify correspondingly throughout, and wherein.

DETAILED DESCRIPTION

The present application describes various embodiments of a sailing vessel that automatically rotates, or "cants", its mast to reduce a heeling moment generated by wind acting upon the sails of the sailing vessel, while still providing a thrust component for propulsion. The concepts described herein are applicable to manned or unmanned monohull vessels, such as traditional sail boats, or multihull vessels, such as catamarans or trimarans. While the embodiments described herein are most useful for multihull vessels to avoid capsizing, they can also be used to reduce the roll, or heel, angle of monohull vessels in order to reduce extreme roll angles that are typically uncomfortable for those onboard. Generally, embodiments of the invention cause a mast to rotate "with the wind", i.e., in a leeward direction, with respect to the deck of a sailing vessel, thereby reducing the rolling moment.

Figure 1:
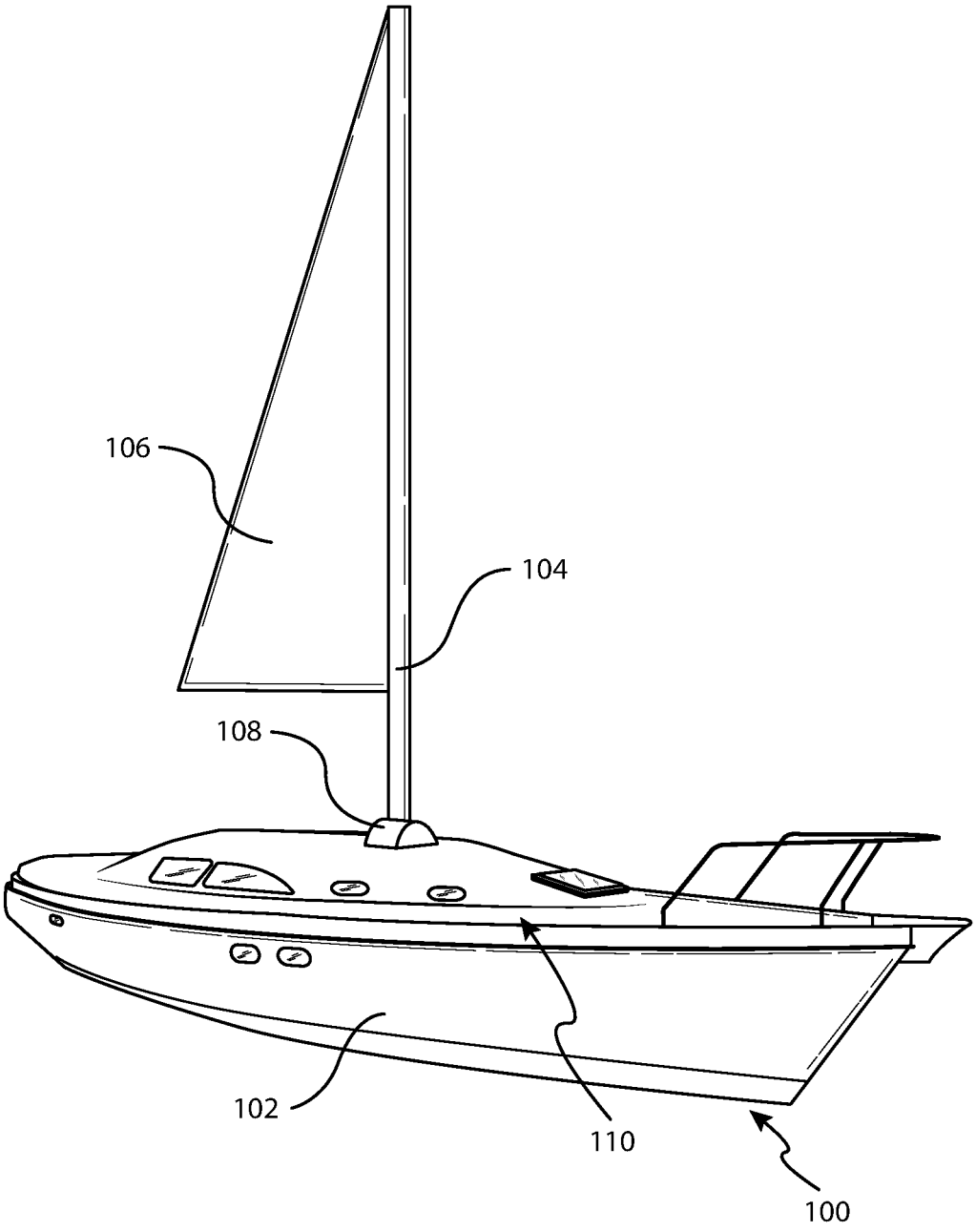
FIG. 1 is a perspective view of one embodiment of a sailing vessel that reduces a heeling moment caused by wind in an embodiment where a mast is allowed to rotate to the port and to the starboard with respect to a deck of the sailing vessel.

FIG. 1 is a perspective view of one embodiment of a sailing vessel 100 that reduces heeling moments caused in an embodiment where a mast is allowed to rotate to the port and to the starboard with respect to a deck of the sailing vessel. Shown is hull 102, mast 104, sail 106, pivot assembly 108 and deck 110. It should be understood that sailing vessel 100 is merely representative of a number of different sailing vessel configurations, and that the inventive concepts described herein are equally applicable to those other configurations. For example, other sailing vessels may utilize two or more sails, be larger or smaller than sailing vessel 100 as shown, comprise two or more hulls, outriggers, rigs that comprise a traditional mast and soft sails (as shown), a rigid wing, a mast and a semi-rigid wing, an inflatable wing, a wind turbine, etc.

Sailing vessel 100, in one embodiment, is 30 feet long, 10 feet wide, comprising a displacement of 10,000 pounds. However, the inventive concepts described herein could be applied to other sailing vessels that are much smaller, or much larger, than these dimensions.

In one embodiment, sail 106 is constructed from a lightweight, substantially rigid material such as molded fiber composite material or aluminum alloy. In cross-section, sail 106 (sometimes referred to as a "wing" or "wingsail") is preferably configured as an airfoil that generates propulsive force (analogous to upward "lift" of an aircraft wing, but in a generally horizontal direction) regardless of whether an angle of attack is to the right or left of the wind, suitable foil configurations being known to those skilled in the relevant art. In another embodiment, the sail is constructed from a lightweight, flexible material such as cloth, nylon, Dacron®, Spectra®, Dyneema®, mylar, carbon fiber, etc. In these embodiments, sail 106 may be partially or fully inflated by the flow and pressure of incident wind, i.e., when sail 106 is formed similar to a ram air hang glider or kite wing.

In prior art sailing vessels, the mast is either rigidly fixed to the hull or the mast may be mounted on a mechanism that allows a mast to rotate fore and aft, forming a "rake" angle that alters the position of an aerodynamic center and thus relates to the relationship between the aerodynamic forces and the hydrodynamic forces generated by the hull(s) and or keel(s). This aero/hydro balance is critical for sailing efficiency. In contrast, sailing vessel 100 comprises mast 104 that is allowed to rotate, or "cant", towards a port side and to a starboard side of sailing vessel 100 when a wind acts upon sail 106. The mast is prevented from falling over to the waterline via a mechanical energy storage mechanism, such as a spring, that will be explained in more detail later here. In other embodiments, a restraint could be used, such as a typical shroud system where two shrouds are coupled near/to a top portion of mast 104 and one shroud coupled to a port side of hull 102 and the other shroud coupled to a starboard side of hull 102, where each shroud may be shortened or elongated by means of either a block and tackle system or a hydraulic ram, stopping mast 104 form falling to the waterline.

Figure 2:
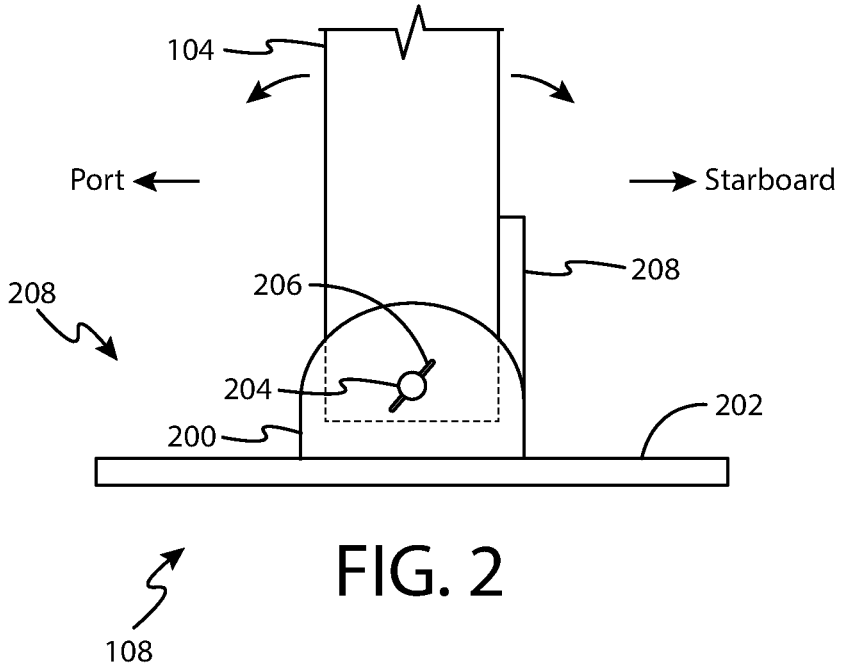
FIG. 2 illustrates an aft view of one embodiment of a pivot assembly as shown in FIG. 1, i.e., from the aft of the sailing vessel shown in FIG. 1, showing one end of mast 104 pivotally mounted to a fixed hub.

FIG. 2 illustrates an aft view of one embodiment of pivot assembly 108, i.e., from the aft of sailing vessel 100, showing one end of mast 104 pivotally mounted to a fixed hub 200. An additional hub 200 is typically used on an opposing side of mast 104, hidden from view in FIG. 2. Both hubs 200 are fixedly coupled to base plate 202 or to deck 110. It should be understood that the relative dimensions shown in FIG. 2 are not to scale.

Mast 104 is rotatably coupled to the hubs 200 via a fulcrum 204, such as a rod, bolt, pin, etc. In this embodiment, mast 104 comprises a through hole bored at a distance from the end of mast 104 that allows the bottom of mast 104 to clear base plate 202. Similarly, a hole is formed through hub 200 in alignment with the hole in mast 104 such that fulcrum 202 may pass through the hole in hub 200, then the hole through mast 104 and finally through another hole formed through the second hub on the opposing side of mast 104. Fulcrum 204 is typically held in place via fastening means 206, such as a nut, cotter pin, retaining snap ring, etc. The combination of the hub(s) 200, base plate 202, fulcrum 204 and fastening means 206 may be referred to herein as a gimbal 208. This configuration allows mast 104 to cant towards the port side of sailing vessel 100 when the wind acts upon sail 106 from the starboard side of sailing vessel 100 and to the starboard side of sailing vessel 100 when the wind acts upon sail 106 from the port side of sailing vessel 100. "Cant", as used herein, generally refers to a rotation of mast 104 in a leeward direction, either to port or to starboard, away from an imaginary vertical axis perpendicular to deck 110.

Mast 104 is prevented from falling to the waterline by a mechanical energy storage means 208, shown in FIG. 2 as a leaf spring. Mechanical energy storage means 208 does this by applying a righting moment to the mast in a windward direction while the mast is canted, thus limiting a cant angle of the mast with respect to a perpendicular axis extending from deck 110. More generally, mechanical energy storage means 208 comprises one or more springs, gas struts, hydraulic rams, etc. that provide a countermoment to mast 104 in order to keep it from falling to the waterline, and for determining how far mast 104 will cant, given various heeling moments. In FIG. 2, the leaf spring is mounted at one end to base plate 202 on the starboard side of mast 104, while a planar surface of the leaf spring rests against or near a surface of mast 104. In some embodiments, a second leaf spring is used, mounted in a similar fashion on the opposing side of mast 104, on the port side of mast 104. When the wind blows upon sail 106 from the port side, a heeling moment is created against sailing vessel 100, causing the entire sailing vessel 100 to roll to the starboard, which causes mast 104 to cant leeward (i.e., towards the starboard) at an angle from the perpendicular to deck 110 by the leaf spring. The mast of the rig is what causes the mast to cant and mechanical energy storage means 208 limits the cant angle by applying a righting moment to mast 104. Generally, the cant angle automatically increases linearly with respect to the heeling moment as the wind speed increases.

Figure 3:
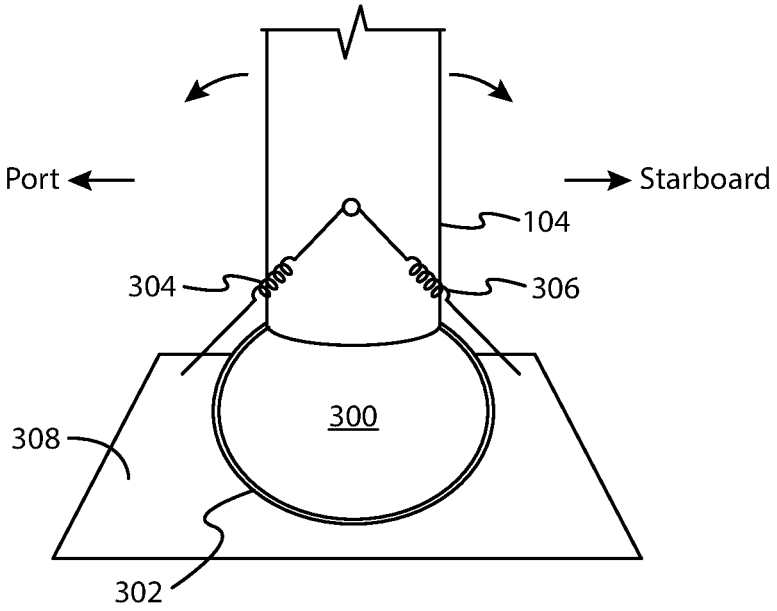
FIG. 3 illustrates an aft, cutaway view of the mast shown in FIGS. 1 and 2, mounted to a gimbal, where one end of the mast is formed into a "ball" and a reciprocating, receiving "socket" is formed into a base.

While rotary assembly 108 is shown in FIG. 2 as a two-axis gimbal, i.e., a mechanism for allowing canting of mast 104 in the port and starboard directions only, in other embodiments, rotary assembly 108 may comprise a three-axis gimbal, as shown in FIG. 3. FIG. 3 illustrates an aft, cutaway view of mast 104 mounted to base 308, where an end 300 of mast 104 is formed into a "ball" and a reciprocating, receiving "socket" 302 is formed into base 308. It should be understood that the relative dimensions shown in FIG. 3 are not to scale. In this configuration, mast 104 is free to rotate in the fore, aft, port and starboard directions, and any position therebetween. In this embodiment, mechanical energy storage means 208 comprises at least two springs, port spring 304 and starboard spring 306. As the wind acts against sail 106 from the port side of sailing vessel 100, generating a clockwise heeling moment on sailing vessel 100, causing mast 104 to rotate clockwise under the weight of the rig, port spring 304 limits the range of cant of mast 104 and prevents mast 104 from falling to the horizontal on the starboard side of sailing vessel 100 by applying a righting moment to mast 104. Conversely, as the wind acts against sail 106 from the starboard side of sailing vessel 100, generating a counter-clockwise heeling moment on sailing vessel 100, causing mast 104 to rotate counterclockwise under the weight of the rig, starboard spring 306 limits the range of cant of mast 104 and prevents mast 104 from falling to the horizontal on the port side of sailing vessel 100.

The "stiffness" or spring constant of mechanical energy storage means 208 is an important design consideration, as it defines how much mast 104 is allowed to cant, given a range of heeling moments. The spring constant or stiffness may be chosen to automatically cant mast 104 leeward to a particular cant angle, given a maximum desirable heeling moment (in single-hull vessels) or maximum heeling angle (i.e., a capsize angle in multi-hull vessels). For example, when sailing vessel is rolled 30 degrees from the vertical by the wind, a spring constant or stiffness may be selected such that mast 104 cants 10 degrees. Allowing mast 104 to cant leeward reduces the heeling moment acting on sailing vessel 100, thus reducing the roll angle of sailing vessel 100 given the same wind conditions. This allows sailing vessel 100 to withstand greater wind conditions before reaching the same maximum desirable heeling moment or maximum heeling angle than would otherwise result if mast 104 were fixedly secured to deck 110. In general, it is desirable to allow mast 104 to cant at an angle of between 0 and 30 degrees when a sailing vessel has been rolled by the wind at an angle of between 20 and 40 degrees.

A heeling moment generated by the wind against sail 106 is approximately a function of a chord of sail 106, a height of sail 106 squared, the cosine of the heeling angle of mast 104 with respect to the vertical, wind speed and apparent wind angle. A righting moment of a multihull is principally defined by a width or "beam" of the vessel, a weight or displacement, and a vertical height of the center of gravity (Cg) that is lower in the water than a center of buoyancy (Cb). The righting moment is also a function of heel angle, initially approximately one-half of the beam times the weight, increasing with the heel angle until a windward outrigger just leaves the water, then decreasing rapidly until the vessel reaches a capsize angle. Ideally, a vessel should be designed so that the maximum righting moment is greater than the expected heeling moment just as the windward outrigger clears the water. From these two relationships, it is possible to calculate a maximum heeling moment that a multi-hull vessel can experience before capsizing and, thus, an amount that mast 104 must cant to keep the heeling moment below the maximum heeling moment. By canting mast 104, the apparent area of sail 106 with respect to the wind is decreased, thus reducing the heeling moment by a factor approximately equal to the cosine of the heeling angle of the vessel caused by the wind.

Ideally, for a multi-hull vessel, mast 104 should remain perpendicular to deck 110 of hull 102 until the vessel is rolled by the wind to the heel angle where the windward hull just comes out of the water, where the heeling moment is at a maximum, and then should cant an amount to maintain the vessel at that heel angle or less (i.e., maintain the maximum heeling moment or reduce it). In this case, mechanical energy storage means 208 is non-linear, i.e., it does not allow mast 104 to cant until a multi-hull sailing vessel is rolled to the capsize angle.

However, in an embodiment where mechanical energy storage means 208 is a linear device, such as a linear spring, then an expected maximum wind speed limit may be placed on the design of a multi-hull vessel, such as 60 knots for example, where a maximum heeling moment will occur at that windspeed. A spring constant may then be chosen to allow mast 104 to cant enough to limit the heeling moment to the maximum heeling moment until the wind blows with enough force to cause the heeling moment to exceed the capsize angle, even with mast 104 canted.

Thus, a spring constant may be chosen by factoring a sail chord, a sail height, a beam of the vessel, a weight of the vessel, a maximum expected wind speed for any given heeling moment and capsize angle.

For example, a J-Class sailboat (a monohull in this example) comprises an approximate righting moment as a function of its ballast, keel dimensions and hull shape, for example 55,000 newton-meters per degree of heel. Typically, when sailing upwind, a J-Class yacht will heel about 25 degrees in 20 knots of wind, and more than 30 degrees in 25 knots of wind.

At 25 degrees of heel, the heeling moment due to the wind acting on the sails and the righting moment of the vessel balance at a value of 25*55,000=1,375,000 newton-meters. If it is desirable to limit the heel to less than 30 degrees, then ideally mast 104 would begin to cant leeward, relative to the deck of hull 102, when the heeling moment exceeds this nominal heeling moment (i.e., 1,375,000 newton-meters). In this ideal embodiment, a non-linear spring mechanism would be used so that mast 104 would remain perpendicular to the deck until the heel angle reaches 25 degrees, and would then allow mast 104 to cant leeward to limit the maximum heeling moment to the 30 degree value (30*55,000=1,650,000 newton meters).

If the spring mechanism comprises a simple linear device, i.e., a spring having a spring constant of, for example, 55,000 newton-meters per degree, then in 20 knots of wind, equilibrium would be reached when the heel angle and mast 104 are about 20.5 degrees from the vertical. Increasing the wind speed to 25 knots produces an equilibrium condition of about 23 degrees of heel, as opposed to a non-canting mast 104 of about 30 degrees. Decreasing the spring constant will allow more cant of mast 104, thus reducing the equilibrium heel angle.

It should be noted that a side effect of allowing mast 104 to cant is that the total equilibrium heeling moment value is reduced, thus the total driving force of sail 106 is reduced, which has a secondary impact on the sailing performance which feeds back to a small impact on the heeling moment, thus the calculation of final equilibrium conditions in terms of heel, and yacht speed, is an iterative process.

Figure 4:
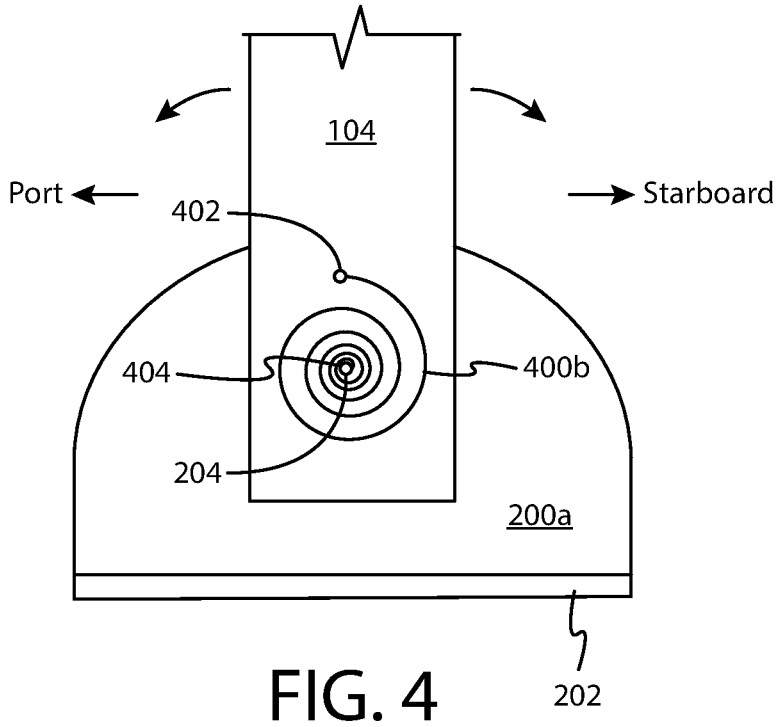
FIG. 4 is an aft, side, cutaway view of another embodiment of the pivot assembly shown in FIG. 1.
Figure 5:
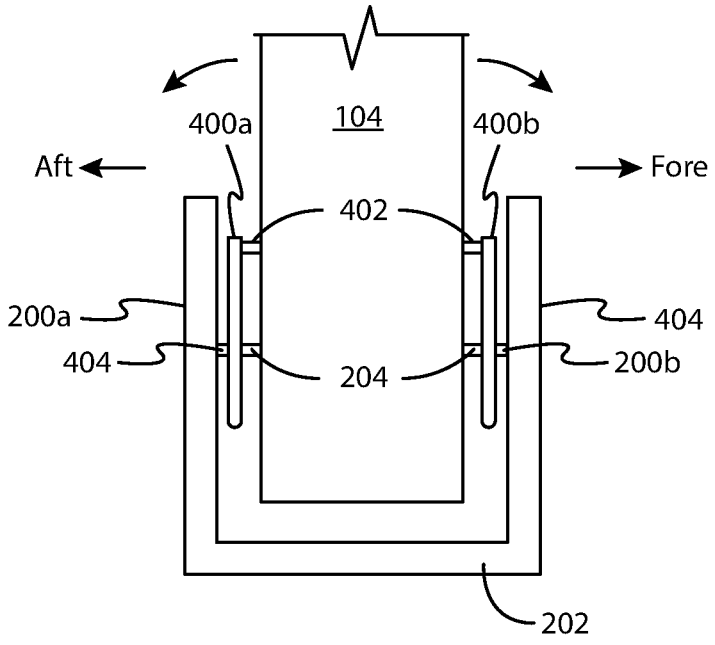
FIG. 5 is a starboard, side view of another embodiment of the pivot assembly of FIG. 1, showing the mast of FIG. 1 rotatably coupled to the pivot assembly via a fulcrum placed through a hole in the mast and a hole through a port hub and a hole through a starboard hub.

FIG. 4 is an aft, side, cutaway view of another embodiment of pivot assembly 108 and FIG. 5 is a starboard, side view of the pivot assembly 108 as shown in FIG. 4, showing mast 104 rotatably coupled to pivot assembly 108 via fulcrum 204 placed through a hole in mast 104 and a hole through a port hub 200*a* and a hole through a starboard hub 200*b* (not shown in FIG. 4 in order to view the detail mechanical energy storage means 208). It should be understood that the relative dimensions shown in FIGS. 4 and 5 are not to scale. In this embodiment, mechanical energy storage means 208 comprises two coil springs, a port coil spring 400*a* (hidden from view by mast 104 in FIG. 4) and a starboard coil spring 400*b*, each having a spring constant that limits the amount of cant of mast 104 towards the port side and to the starboard side of sailing vessel 100 with respect to deck 110, thus allowing a reduction in a heeling moment to sailing vessel 100 caused by the wind acting on sail 106, as discussed above. Each coil spring is mechanically coupled at a first end 402 to mast 104 and at a second end 404 to each hub 200, respectively, and the coil springs are mounted such that when the mast cants in one direction, one of the coil springs becomes coiled, generating a counter-moment, or righting moment, against mast 104 while the other coil spring uncoils, generating little to no torque on mast 104, and vice versa. As a wind acts upon sail 106 from the starboard side of sailing vessel 100, mast 104 is canted towards the port side (leeward) of sailing vessel 100 with respect to deck 110 by the weight of the rig, and coil spring 400*b* resists this moment, limiting the range of cant to the port. The amount that mast 104 is allowed to cant with respect to deck 110 is determined by the spring constant of each coil spring, the height of mast 104, the area of sail 106 and other factors as discussed above. Similarly, when a wind acts upon sail 106 from the port side of sailing vessel 100, mast 104 cants towards the starboard side (leeward) of sailing vessel 100 with respect to deck 110 by the weight of the rig, and coil spring 400*a* resists this moment, limiting the range of cant towards the starboard.

Figure 6:
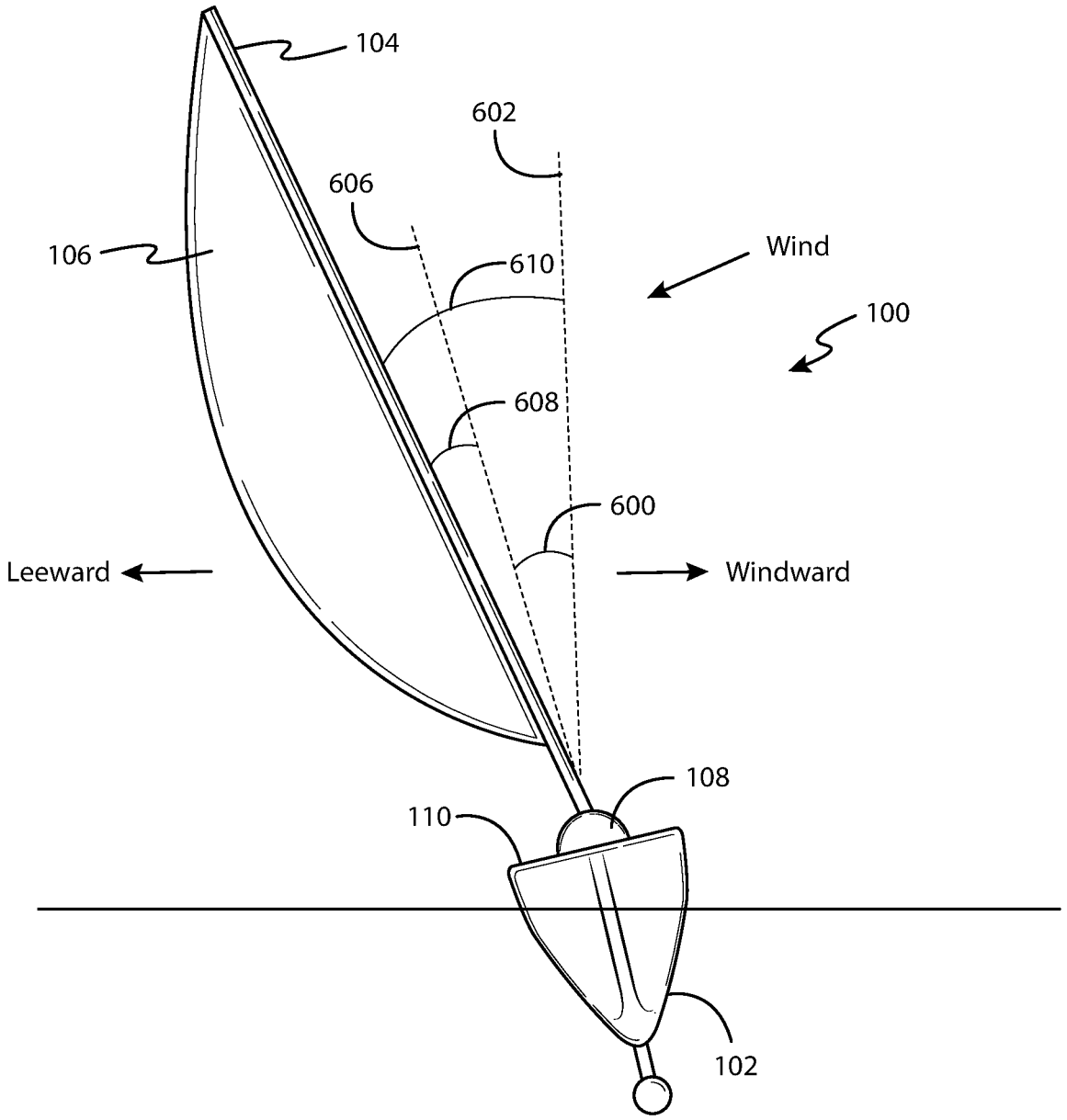
FIG. 6 is an aft view of one embodiment of a single-hull sailing vessel with a wind acting on its sail from a starboard side of the sailing vessel, configured to allow the sail to cant towards the port side and to the starboard side of the sailing vessel with respect to the deck of the hull of the sailing vessel.

FIG. 6 is an aft view of one embodiment of a single-hull sailing vessel 100 with a wind acting on sail 106 from a starboard side of sailing vessel 100, configured to allow sail 106 to cant towards the port side of sailing vessel 100 (and to the starboard side of sailing vessel 100 when the wind blows from the port side) with respect to deck 110 of hull 102. It should be understood that the relative dimensions and angles shown in FIG. 6 are not to scale. For purposes of discussion, with the wind coming from the starboard side of sailing vessel 100, a direction into the wind may be referred to herein as "windward" while a direction with the wind may be referred to herein as "leeward".

FIG. 6 shows single-hull sailing vessel 100 at a maximum desired heeling angle 600, i.e., an angle 600 between an imaginary vertical axis 602 and an imaginary axis 606 perpendicular to deck 110 as the wind blows against sail 106 from the starboard side of single-hull sailing vessel 100. Imaginary axis 606 represents an axis where mast 104 would be positioned if it were not rotatable via pivot assembly 108. The maximum desired heeling angle 600 is an angle at which persons onboard sailing vessel 100 may not be able to stand or otherwise be comfortable. For example, the maximum heeling angle 600 may be selected during design of sailing vessel 100 to be 40 degrees from vertical axis 602.

As the wind acts upon sail 106 from the starboard side, it generates a heeling moment that causes single-hull sailing vessel 100 to roll towards the port side. The maximum desired heeling angle 600 is achieved when the wind blows with such velocity as to create a maximum heeling moment against single-hull sailing vessel 100. The maximum heeling moment may be approximated using physical dimensions and characteristics of single-hull sailing vessel 100, such as the chord of sail 106, a height of sail 106 squared, the cosine of heeling angle 600, the wind speed and an apparent wind angle.

As single-hull sailing vessel 100 begins rolling as a result of the wind acting on sail 106 from the starboard side, mast 104 automatically cants to the port side (i.e., leeward) with respect to deck 604 under the weight of the rig via rotary assembly 108, forming a cant angle 608 with respect to imaginary axis 606, generally in proportion to the heeling moment experienced by single-hull sailing vessel 100 when mechanical energy storage means 208 comprises one or more linear springs. In an embodiment that utilizes one or more non-linear springs or other mechanical devices, mast 104 remains generally perpendicular to deck 110 as the wind acts on sail 106 until single-hull sailing vessel 100 (and mast 104) is at or near (i.e., within 1 to 10 degrees) of maximum desired heeling angle 600. At this point, mast 104 begins canting leeward towards the port side in order to reduce the heeling moment experienced by single-hull sailing vessel 100 at or near the maximum desired heeling angle 600.

In one embodiment, mast 104 is allowed to rotate until it reaches a maximum cant angle 608, such as 5 degrees. The amount of cant is determined by the spring constant or restoring force of mechanical energy storage means 208, the weight of mast 104 and sail 106, and the wind speed and direction. In another embodiment, where the spring constant or stiffness is less, mast 104 may continue to rotate past maximum cant angle 608, which would continue to reduce the heeling moment on single-hull sailing vessel 100.

Figure 7:
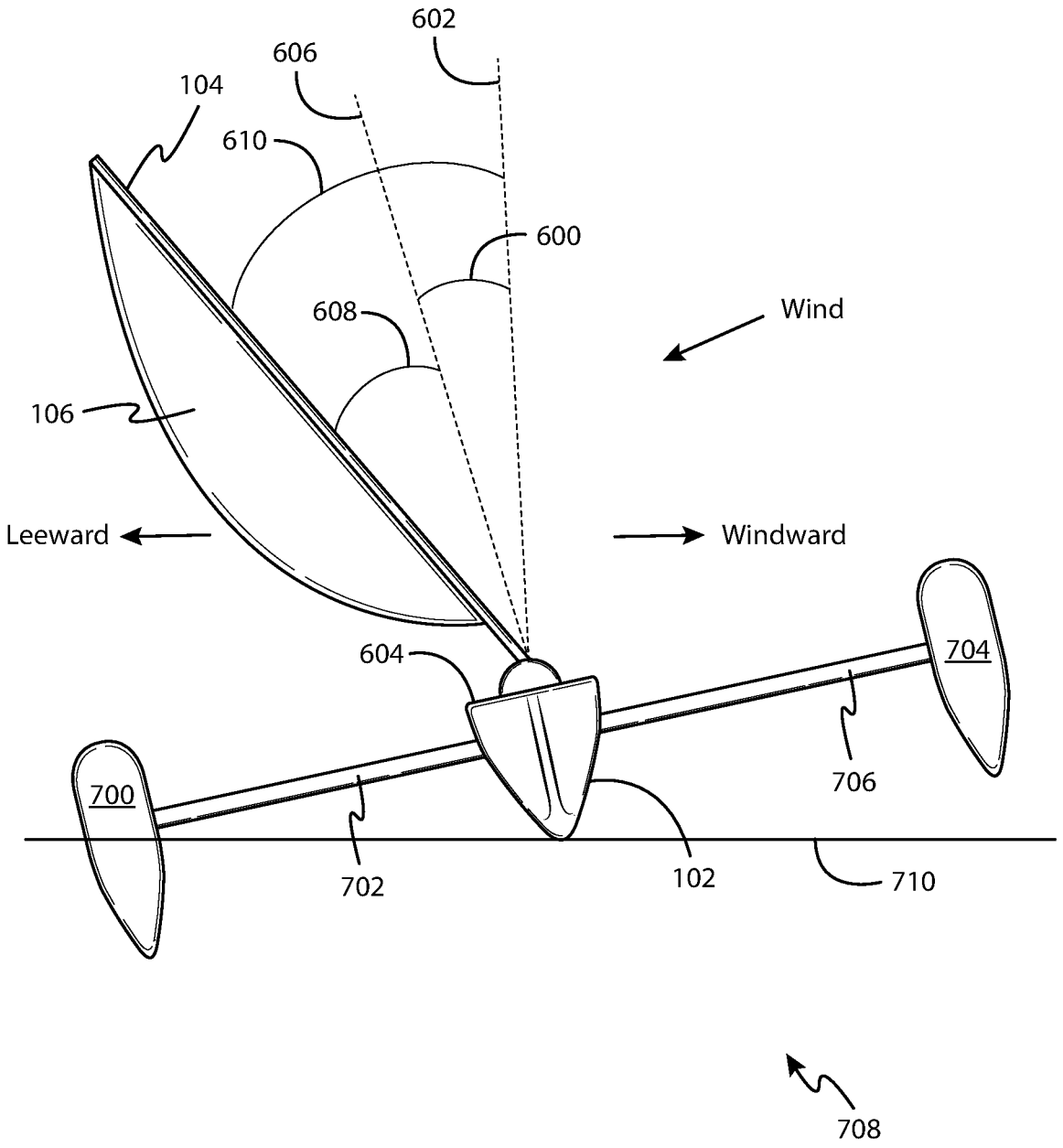
FIG. 7 is an aft view of one embodiment of a multi-hull sailing vessel, comprising the pivot assembly of FIG. 1 that allows a mast to rotate with respect to a deck of the multi-hull sailing vessel in order to reduce a heeling moment acting on the vessel when a wind acts on the sail.

FIG. 7 is an aft view of one embodiment of a multi-hull sailing vessel 708, in this embodiment, a trimaran, comprising pivot assembly 108 that allows mast 104 to cant with respect to deck 110 in order to reduce a heeling moment acting on multi-hull sailing vessel 708 when the wind acts on sail 106. It should be understood that the relative dimensions and angles shown in FIG. 7 are not to scale. Multi-hull sailing vessel 708 comprises elements similar to the single-hull sailing vessel 100 as shown in FIG. 6, with an addition of port outrigger 700 coupled to center hull 102 via at least two cross beams 702 (only one of which is shown as the other is hidden from view in FIG. 7) and starboard outrigger 704 coupled to center hull 102 via at least two cross beams 706 (only one of which is shown as the other is hidden from view in FIG. 7).

Similar to the single-hull sailing vessel 100 as shown in FIG. 6, multi-hull sailing vessel 708 will roll to the port side or to the starboard side by a heeling moment created against multi-hull sailing vessel 708 when a sufficient wind force acts on sail 106 from the starboard side or port side, respectively. When rolled, one or the other outriggers may be lifted out of the water 710, as shown in FIG. 7. However, without use of pivot assembly 108, if multi-hull sailing vessel 708 is rolled past a capsize angle 600, the heeling moment overcomes the righting moment (caused by the weight of mast 104, sail 106, and one of the outriggers and cross beams), it will generally capsize. Utilizing pivot assembly 108, mast 104 is allowed to cant past the capsize angle 600, forming cant angle 608 with respect to imaginary axis 606 that is perpendicular to deck 110. As mast 104 is allowed to cant past capsize angle 600, the heeling moment against multi-hull sailing vessel 708 is reduced, thus avoiding capsizing.

As in the embodiment shown in FIG. 6, as multi-hull sailing vessel 708 begins to roll as a result of a heeling moment applied to multi-hull sailing vessel 708 by the wind acting on sail 106 from the starboard, mast 104 begins canting in a leeward direction with respect to deck 110 (i.e., towards the port) due to the weight of the rig, forming cant angle 608, generally in proportion to the heeling moment when mechanical energy storage means 208 comprises one or more linear springs. In an embodiment that utilizes one or more non-linear springs or other non-linear mechanical devices, mast 104 remains generally perpendicular to deck 110 as the wind acts on sail 106 until multi-hull sailing vessel 708 (and mast 104) is at or near capsize angle 600. At this point, mechanical energy storage means 208 begins allowing mast 104 to cant leeward in order to reduce the heeling moment experienced by multi-hull sailing vessel 708, thus allowing the wind to blow harder against sail 106 than would normally be allowed before capsizing.

Also similar to the embodiment shown in FIG. 6, in one embodiment, mast 104 is allowed to cant until it reaches a maximum cant angle 608, such as 25 degrees. The amount of cant is determined by the spring constant or restoring force of mechanical energy storage means 208 and the righting moment created by the weight of mast 104, sail 106, one of the outriggers and associated cross beams, and the wind speed and direction. In another embodiment, mast 104 may continue to rotate past maximum cant angle 608, which would continue to reduce the heeling moment on multi-hull sailing vessel 708.

Figure 8:
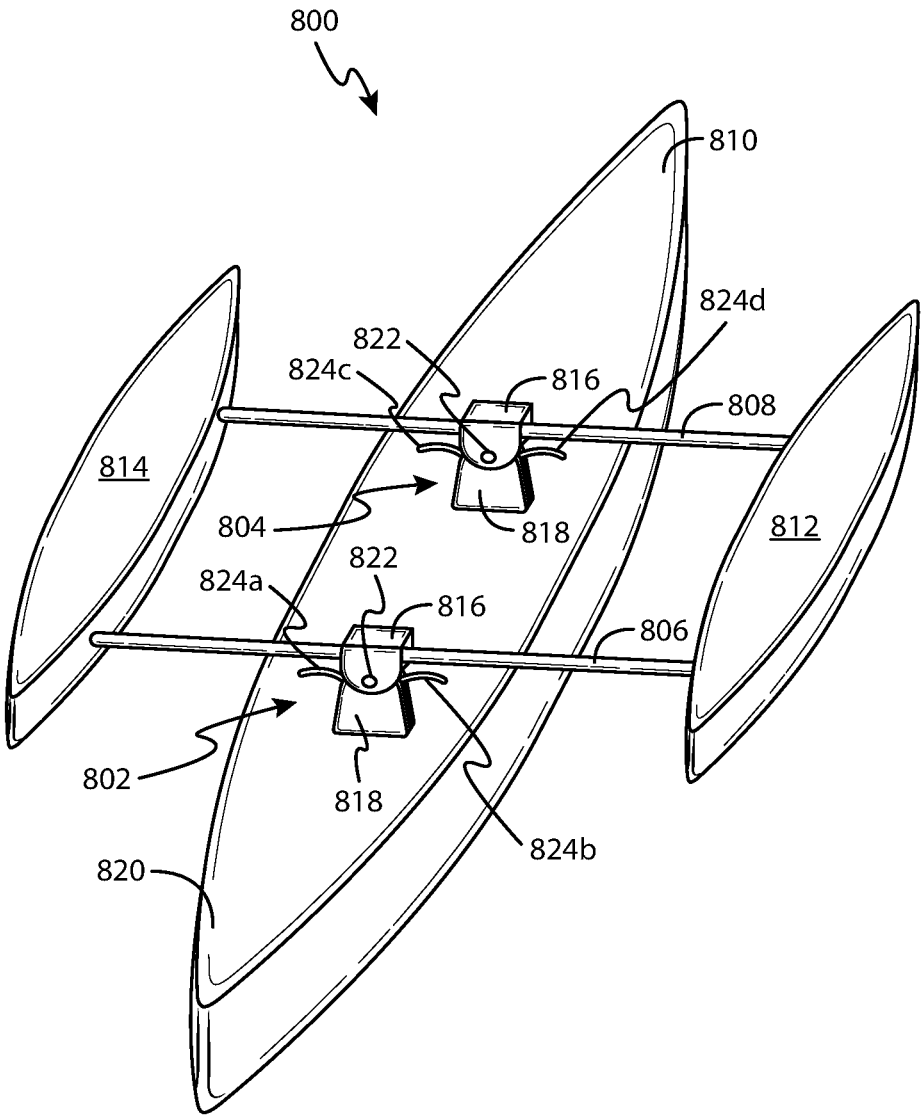
FIG. 8 is a perspective view of another embodiment of a multi-hull sailing vessel, comprising a fore pivot assembly and an aft pivot assembly coupled to a fore cross beam and an aft cross beam.
Figure 9:
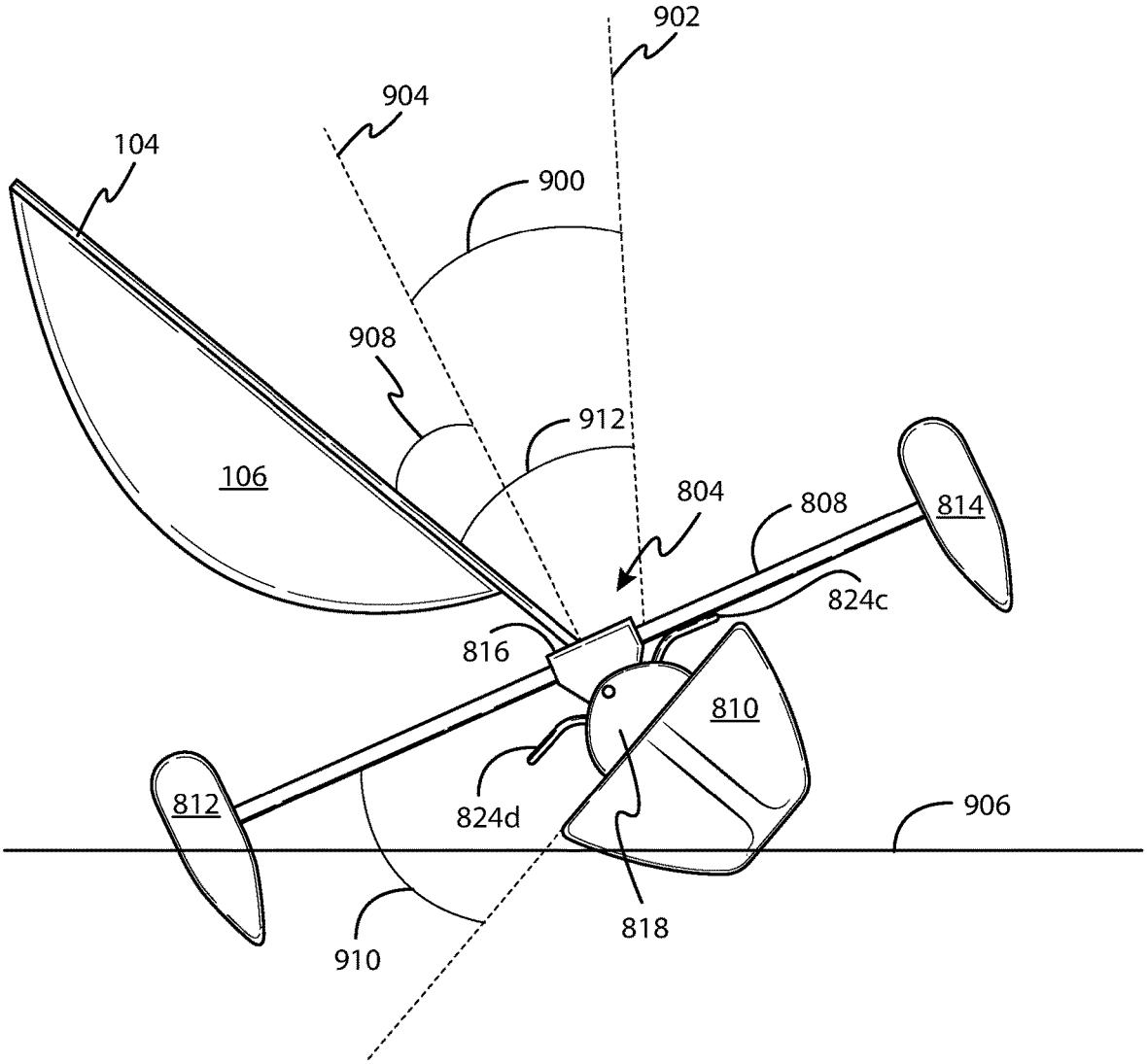
FIG. 9 is an aft view of the multi-hull sailing vessel as shown in FIG. 8, shown with a cross beam rotated to a maximum heeling angle.

FIG. 8 is a perspective view of another embodiment of a multi-hull sailing vessel, shown as multi-hull sailing vessel 800, comprising a fore pivot assembly 802 and an aft pivot assembly 804 coupling a fore cross beam 806 and an aft cross beam 808 to center hull 810 that allows center hull 810 to rotate to the port and to the starboard with respect to port outrigger 812 and starboard outrigger 814 in order to reduce a heeling moment acting on multi-hull sailing vessel 800 when the wind acts on mast and a sail of multi-hull sailing vessel 800. It should be understood that the relative dimensions and angles shown in FIG. 8 are not to scale. The mast and sail of multi-hull sailing vessel 800 is omitted from the view shown in FIG. 8 in order to better illustrate the two pivot assemblies, but that the mast and sail are shown in FIG. 9. It should be understood, however, that in this embodiment, the mast is fixedly coupled to center hull 810.

Each of the pivot assemblies comprises a first portion 816 coupled to a respective cross beam, as shown, and a second portion 818 coupled to a deck 820 of center hull 810. The two portions of each assembly are rotatably coupled together via rotary coupler 822, such as a pin, a rotary collar, or some other well-known rotary coupling device, allowing center hull 810 to rotate clockwise and counter-clockwise, or to the port and starboard.

Each of the pivot assemblies may comprise one or more mechanical energy storage means 824, shown in this embodiment as a pair of leaf springs extending from each pivot assembly. In other embodiments, only one of the two pivot assemblies comprises one or more mechanical energy storage means 824. In this embodiment, when the wind acts on sail 106 from the starboard, fore leaf spring 824*a* and aft rear spring 824*c* act upon fore cross beam 806 and aft cross beam 808, respectively, thus resisting the heeling moment caused by the wind and allowing center hull 810 and mast 104 to cant leeward, or counterclockwise, towards the port with respect to the outriggers. Similarly, when the wind blows from the port side, fore leaf spring 824*b* and aft rear spring 824*d* act upon fore cross beam 806 and aft cross beam 808, respectively, resisting the heeling moment caused by the wind and allowing center hull 810 and mast 104 to cant leeward, or clockwise to the starboard.

Each of the mechanical energy storage means 824 comprises a spring constant or stiffness that limits the cant of mast 104 as wind acts on the sail. The greater the spring constant or stiffness, the less the mast will cant, and vice-versa.

It should be understood that although multi-hull sailing vessel 800 is shown comprising two mechanical energy storage means 824 (one fore and one aft), in other embodiments, only one mechanical energy storage means 824 is used, either in fore pivot assembly 802 or aft pivot assembly 804.

FIG. 9 is an aft view of multi-hull sailing vessel 800, shown with cross beam 808 rotated to a capsize angle 900 formed between an imaginary vertical axis 902 perpendicular to waterline 906 and an imaginary axis 904 perpendicular to cross beam 808 as the wind blows against sail 106 from the starboard. It should be understood that the relative dimensions and angles shown in FIG. 9 are not to scale. Cross beam 806 is hidden from view behind cross beam 808. The capsize angle 900 is the maximum angle from the vertical that multi-hull sailing vessel 800, i.e., cross beams 808 and 806, can roll with respect to vertical axis 902 before multi-hull sailing vessel 800 capsizes.

As the wind begins to act upon sail 106, a heeling moment is created and applied to multi-hull sailing vessel 800, causing center hull 810 to rotate counter-clockwise, or to the port side. Mechanical energy storage means 208, in this case leaf spring 824*c* contacts an underside of aft cross beam 808 (as well as leaf spring 824*a* contacting an underside of aft cross beam 806, hidden from view), which resists the heeling moment, allowing mast 104 and hull 810 to cant to a canting angle 908 as shown. Thus, center hull 810 and mast 104 operate at a differential angle 910 with respect to one another, and different angles with respect to vertical axis 904 (i.e., center hull 810/mast 104 at angle 912 from vertical axis 904 and cross beams 806/808 at angle 900 from vertical axis 904).

Allowing center hull 810 and mast 104 to cant to canting angle 908 reduces the heeling moment experienced by multi-hull sailing vessel 800 so that multi-hull sailing vessel 800 can withstand greater winds without capsizing than would otherwise be possible if center hull 810 were fixed to cross beams 806/808.

Figure 10:
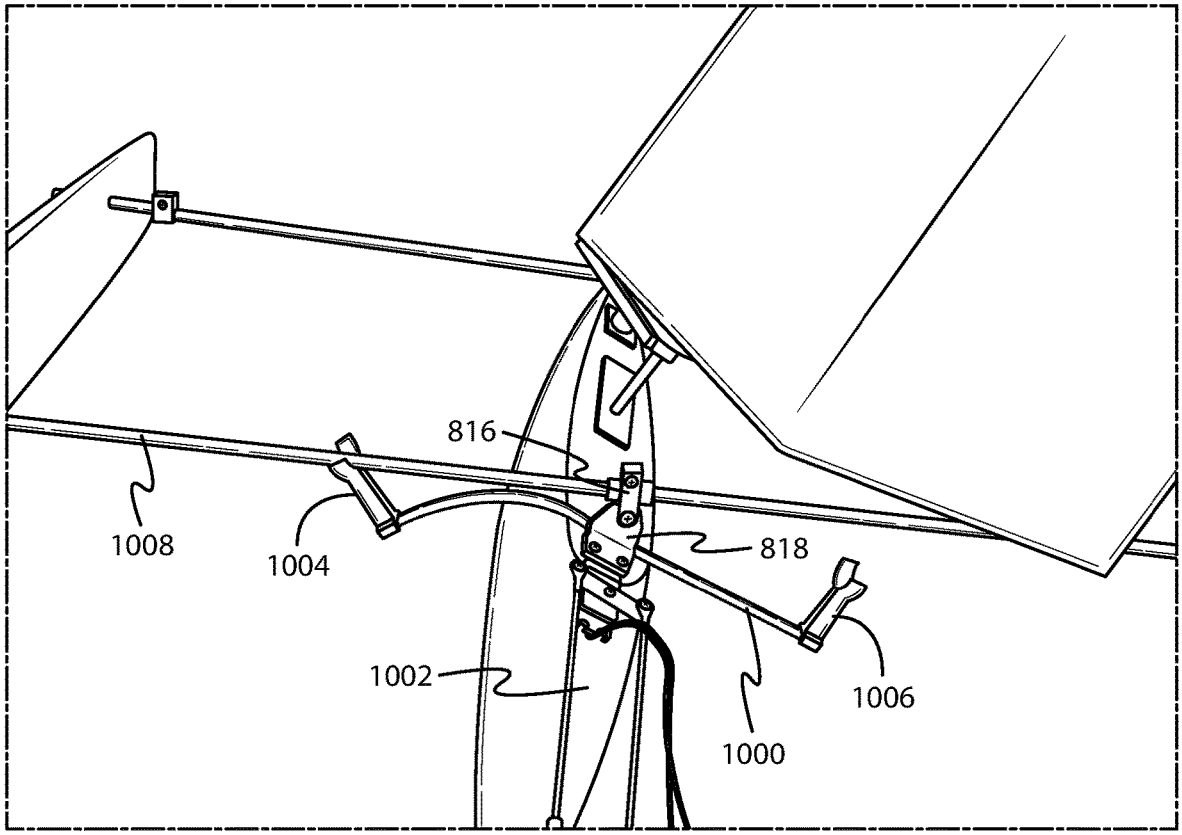
FIG. 10 is an aft view of another embodiment a mechanical energy storage means for use with the embodiment similar to the embodiment shown in FIG. 8.

It should be understood that although the multi-hull sailing vessel 800 shown in FIGS. 8 and 9 utilize fore pivot assembly 802 and aft pivot assembly 804 to allow center hull 810/mast 104 to rotate/cant with respect to cross beams 806/808, other mechanical arrangements are contemplated in order to implement the inventive concept of allowing a center hull and mast to rotate/cant as a wind acts on one or more sails of a multi-hull vessel in order to reduce a heeling moment. For example, FIG. 10 illustrates an aft view of a multi-hull sailing vessel an embodiment where mechanical energy storage means 208 comprises a leaf spring 1000 coupled to a deck 1002 perpendicularly to a fore-aft axis of the vessel, with a port extension 1004 and a starboard extension 1006 extending upwards from each end of leaf spring 1000, respectively. When sailing vessel 1000 is rolled clockwise by a heeling moment caused by a wind from the port, as shown, extension 1004 contacts aft cross beam 1106, which resists the heeling moment and causes center hull 1002 and mast 104 to cant leeward, i.e., clockwise, towards the starboard, and vice-versa. The harder the wind blows, the more center hull 1002 and mast 104 is canted, limited by the stiffness or spring constant of leaf spring 1000.

Figure 11:
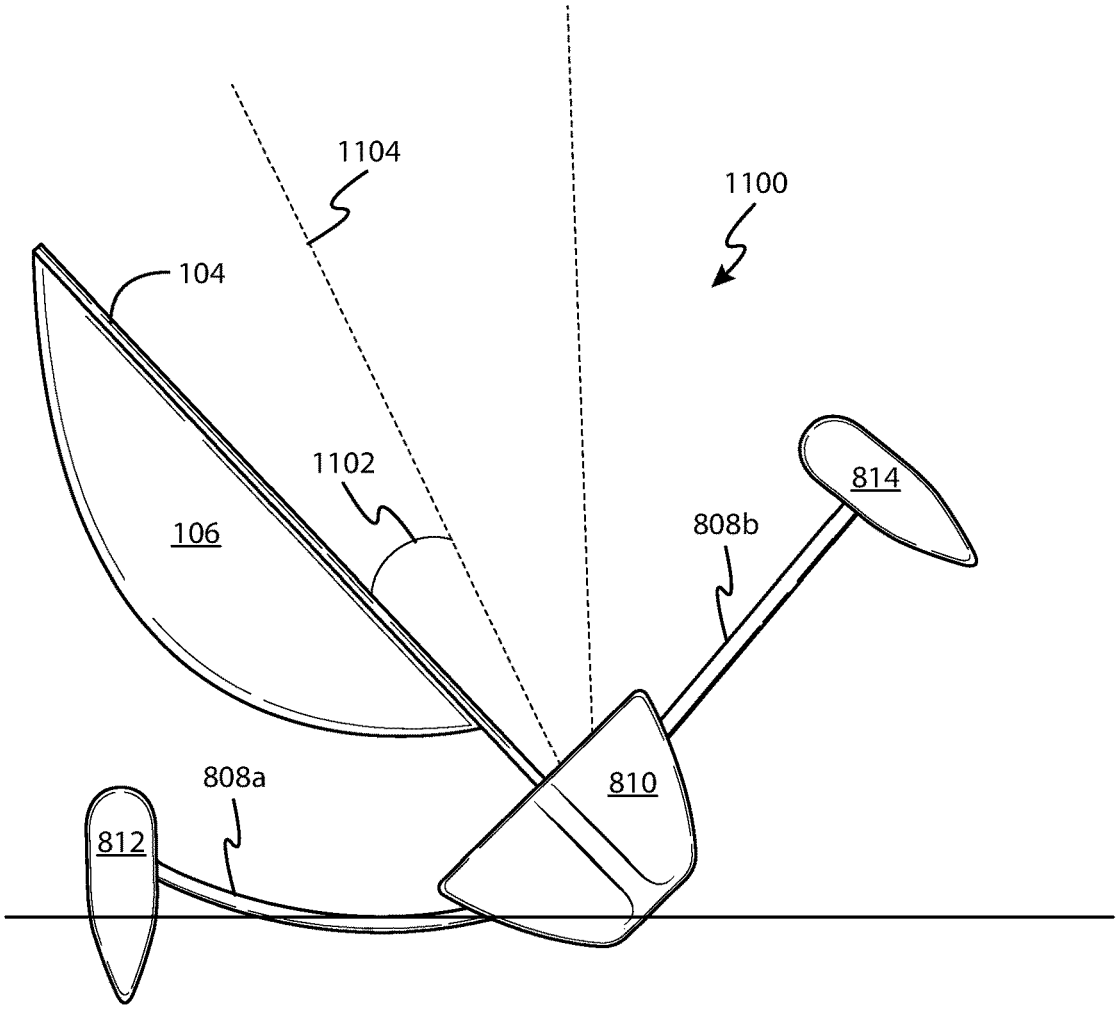
FIG. 11 is an aft view of another embodiment of a multi-hull sailing vessel, comprising components similar to the embodiment shown in FIGS. 8 and 9.

FIG. 11 is an aft view of another embodiment of a multi-hull sailing vessel, shown as multi-hull sailing vessel 1100, comprising components similar to the embodiment shown in FIGS. 8 and 9. It should be understood that the relative dimensions and angles shown in FIG. 11 are not to scale. In this embodiment, fore cross beam 806 is replaced by two, shorter, fore cross beams 806*a* and 806*b* (not shown in this view), fore port cross beam 806*a* coupling a fore portion of center hull 810 to port outrigger 812 and fore starboard cross beam 806*b* coupling the fore portion of center hull 810 to starboard outrigger 814, and aft cross beam 808 is replaced by two, shorter, aft cross beams 808*a* and 808*b*, aft port cross beam 808*a* coupling an aft portion of center hull 810 to port outrigger 812 and aft starboard cross beam 808*b* coupling a starboard, port, aft portion of center hull 810 to an aft portion of starboard outrigger 814.

In this embodiment, each of the cross beams are formed from a semi-rigid material, such as fiber reinforced composite material, having a stiffness that allows center hull 810 and mast 104 to cant to a predetermined canting angle 1102 from an imaginary axis 1104 from where mast 104 would be positioned, given the same heeling moment applied to multi-hull sailing vessel 1100 given the same wind speed and apparent wind direction, while maintaining a horizontal relationship between center hull 810 and each outrigger when a heeling moment is not acting on multi-hull vessel 1100, or when one outrigger is lifted out of the water (for example, outrigger 814 as shown in FIG. 10).

While the foregoing disclosure shows illustrative embodiments of the invention, it should be noted that various changes and modifications could be made herein without departing from the scope of the embodiments as defined by the appended claims. Furthermore, although elements of the invention may be described or claimed in the singular, the plural is contemplated unless limitation to the singular is explicitly stated.

I claim:

1. A sailing vessel for sailing on water, the sailing vessel configured to reduce a heeling moment acting on the sailing vessel, comprising;

a hull;

a mast;

a sail coupled to the mast;

a pivot assembly for allowing the mast to cant to port or to starboard in a leeward direction when a wind acts on the sail, the mast forming a predetermined cant angle with an imaginary axis extending perpendicularly from a deck of the hull, wherein the pivot assembly comprises mechanical energy storage means for applying a righting moment against the mast in a windward direction while the mast is canted, limiting the cant angle to a predetermined angle associated with a particular heeling moment;

a left outrigger;

a right outrigger coupled to the left outrigger via a fore cross beam and an aft cross beam;

a fore pivot assembly comprising a first fore portion coupled to the fore cross beam and a second fore portion coupled to the hull, the first fore portion and the second fore portion rotatably coupled together via a fore rotary coupler; and an aft pivot assembly comprising a first aft portion coupled to the fore cross beam and a second aft portion coupled to the hull, the first aft portion and the second aft portion rotatably coupled together via an aft rotary coupler.

2. The sailing vessel of claim 1, wherein the predetermined cant angle comprises an angle between 0 and 30 degrees when the sailing vessel has been rolled to an angle of between 20 and 40 degrees.

3. The sailing vessel of claim 1, wherein the predetermined cant angle varies in association with the heeling moment.

4. The sailing vessel of claim 1, wherein the mechanical energy storage means comprises a leaf spring comprising a first end mounted to a base of the pivot assembly and a planar surface positioned near or against a surface of a first end of the mast;

wherein the leaf spring provides the righting moment against the mast in the windward direction while the mast is canted.

5. The sailing vessel of claim 1, wherein the mechanical energy storage means comprises a linear spring.

6. The sailing vessel of claim 1, wherein the mechanical energy storage means comprises a non-linear mechanism for maintaining the mast at an angle substantially perpendicular to the deck until the sailing vessel achieves a predetermined roll angle and then allowing the mast to cant leeward when the sailing vessel rolls past the predetermined angle.

7. The sailing vessel of claim 6, wherein the sailing vessel comprises a multi-hull vessel, and the predetermined roll angle comprises a capsize angle at which point the multi-hull vessel would capsize but for allowing the mast to cant leeward.

8. The sailing vessel of claim 1, wherein:

the first pivot assembly comprises a second mechanical energy storage means that applies a restoring force to the fore cross beam as the wind causes the hull to cant.

9. The sailing vessel of claim 1, wherein the mechanical energy storage means comprises a predetermined spring constant that defines a particular righting moment associated with a maximum expected heeling moment.

10. A method for reducing a heeling moment acting on a multi-hull sailing vessel, the multi-hull sailing vessel comprising a mast coupled to a center hull that is rotatably coupled to a fore cross beam and to an aft cross beam via a fore rotary assembly and an aft rotary assembly, respectively, the method comprising:

automatically allowing the mast to cant in a leeward direction when a wind acts on a sail coupled to the mast as the heeling moment increases, thus maintaining the multi-hull sailing vessel at an angle with respect to an imaginary vertical axis of less than a maximum heeling angle; and automatically limiting the mast from canting past the maximum heeling angle.

11. The method of claim 10, wherein automatically allowing the mast to cant comprises:

allowing the mast to cant at an angle in proportion to the heeling moment acting on the sailing vessel as the wind acts on the sail.

12. The method of claim 10, further comprising:

automatically limiting a cant angle of the center hull by a mechanical energy storage means coupled between at least one of the cross beams and the center hull.

13. The method of claim 10, wherein automatically limiting the mast from canting past a maximum desired heeling angle comprises selecting a mechanical energy storage means having a spring constant that defines a particular righting moment associated with a maximum expected heeling moment.

14. A method for reducing a heeling moment acting on a multi-hull sailing vessel, the multi-hull sailing vessel comprising a mast coupled to a center hull that is rotatably coupled to a fore cross beam and to an aft cross beam via a fore rotary assembly and an aft rotary assembly, respectively, the method comprising:

automatically allowing the mast to cant in a leeward direction when a wind acts on a sail coupled to the mast, thus maintaining the multi-hull sailing vessel at an angle with respect to an imaginary vertical axis of less than a maximum heeling angle;

automatically limiting the mast from canting past the maximum heeling angle, wherein the maximum heeling angle comprises a capsize angle at which point the multi-hull sailing vessel would capsize but for allowing the center hull and mast to cant with respect to the outriggers.

15. A method for reducing a heeling moment acting on a multi-hull sailing vessel, wherein the multi-hull sailing vessel comprise a center hull coupled to a port outrigger via a port fore cross beam and a port aft cross beam and to a starboard outrigger via a starboard fore cross beam and a starboard aft cross beam, the method comprising:

forming the port fore cross beam, the port aft cross beam, the starboard fore cross beam and the starboard aft cross beam of a semi rigid material that allows the port fore cross beam and the port aft cross beam to flex when the wind acts on the sail from the starboard, allowing the center hull to cant leeward and the mast leeward, and the starboard fore cross beam and the starboard aft cross beam to flex when the wind acts on the sail from the port, allowing the center hull to cant leeward and the mast leeward:

automatically allowing a mast of the sailing vessel to cant in a leeward direction when a wind acts on a sail coupled to the mast, thus maintaining the multi-hull sailing vessel at an angle with respect to an imaginary vertical axis of less than a maximum heeling angle; and automatically limiting the mast from canting past the maximum heeling angle.

* * * * *